US005620069A

United States Patent [19]

Hurwitz

[11] Patent Number: 5,620,069

[45] Date of Patent: Apr. 15, 1997

[54] SOFT-SIDED LUGGAGE WITH COLLAPSIBLE FRAME

[76] Inventor: Gregory J. Hurwitz, 38 Cecelia Terr., Rochester, N.Y. 14622

[21] Appl. No.: 421,428

[22] Filed: Apr. 12, 1995

[51] Int. Cl.[6] ..... A45C 7/00; A45C 13/04; A45C 13/26; A45C 13/30

[52] U.S. Cl. ..... 190/107; 190/24; 190/127; 150/130; 150/900; 383/33

[58] Field of Search ..... 150/900, 130; 190/103, 107, 127, 24; 383/33, 109

[56] References Cited

U.S. PATENT DOCUMENTS

| | | | |
|---|---|---|---|
| 1,040,300 | 10/1912 | Fitzgerald | 190/107 |
| 1,522,269 | 1/1925 | Recker | 190/122 |
| 1,697,916 | 1/1929 | Kaufmann | 383/33 X |
| 2,018,809 | 10/1935 | Rodgers | 190/103 |
| 2,182,879 | 12/1939 | Rinehart | 190/903 X |
| 2,373,573 | 4/1945 | Langford et al. | 190/127 |
| 2,795,259 | 6/1957 | Nash | 150/900 |
| 2,804,114 | 8/1957 | Nash | 150/900 |
| 3,473,713 | 10/1969 | Campbell | 190/107 X |
| 3,587,794 | 6/1971 | Mattel | 190/107 X |
| 3,730,308 | 5/1973 | Pelavin | 190/127 X |
| 4,210,230 | 7/1980 | Weiner | 190/107 |
| 4,248,364 | 2/1981 | Anderson | 383/33 X |
| 4,598,802 | 7/1986 | Abenaim | 190/107 |
| 4,610,334 | 9/1986 | Pelavin | 190/127 X |
| 4,895,230 | 1/1990 | King | 190/103 X |
| 4,951,818 | 8/1990 | Johnson | 190/107 X |
| 5,178,245 | 1/1993 | Cox | 190/107 |
| 5,251,731 | 10/1993 | Cassese et al. | 190/107 |

FOREIGN PATENT DOCUMENTS

| | | | |
|---|---|---|---|
| 969954 | 12/1957 | France | 190/107 |
| 1315104 | 12/1962 | France | 190/107 |
| 1427179 | 12/1965 | France | 190/107 |
| 545066 | 2/1957 | Italy | 190/107 |
| 158755 | 2/1921 | United Kingdom | 190/127 |
| 580953 | 9/1946 | United Kingdom | 190/107 |

*Primary Examiner*—Sue A. Weaver
*Attorney, Agent, or Firm*—Eugene Stephens & Associates

[57] ABSTRACT

A framed duffel bag has a fabric shell having a box shape with four sides joined by a bottom and a zip-open top. Three framing members made from strips of resilient material hold the four sides erect. Each of the strips is formed with two bends that separate a base from two arms that extend perpendicular to the base. The strips are threaded into channels formed along the bottom and two sides. The two sides are foldable toward the bottom against resilient torques generated by the strips, and the bottom is foldable in half to further compact the bag.

20 Claims, 4 Drawing Sheets

SOFT-SIDED LUGGAGE WITH COLLAPSIBLE FRAME

TECHNICAL FIELD

The invention relates to soft-sided luggage, including transport or storage gear that retains an open form for loading but can be stored in a more compact form.

BACKGROUND

Soft-sided luggage, especially duffel bags, has become popular because of its lightweight yet durable construction. Some soft-sided luggage is also collapsible for occupying less storage space when not in use. These can have fabric shells that are unframed (like most duffel bags) or are framed by assemblies that can be taken apart for collapsing the fabric shells.

For example, U.S. Pat. No. 5,178,245 to Cox discloses a suitcase shell reinforced by removable resilient loops. End compartments of the shell can be opened for removing the loops and collapsing the shell. U.S. Pat. No. 4,598,802 to Abenaim discloses a suitcase with a central band-like frame having a U-shaped base and two hinged arms. Two side walls can be detached from the frame, and the hinged arms can be disconnected and folded along with the side walls into the base.

The suitcases of both Cox and Abenaim require disassembly to collapse. For example, parts of their shells must be opened or removed to expose their frames, and their frames must be removed or dismantled to complete the collapse. Such disassembly is time consuming and, if done improperly, could damage the luggage. Subsequent reassembly has similar problems. Also, breakdown of the suitcase assemblies into parts adds possibilities for misplacing one or more parts, rendering the suitcase unusable.

Duffel bags ordinarily do not have frames and can be collapsed without significant resistance. However, such bags can be difficult to pack because they do not retain a fixed form. Small openings in duffel bags are difficult to access, and large openings allow contents to spill out.

SUMMARY OF INVENTION

My invention relates to soft-sided luggage including duffel bags, backpacks, briefcases, suitcases, trunks, pet carriers, and other such luggage that is lightweight, inexpensive, and collapsible but can be held open by a resilient frame for loading. The frame is attached to a shell and does not have to be disassembled or removed to collapse the shell.

One version of my invention includes a box-shaped fabric shell having four sides joined by a bottom and a zip-open top. Framing members hold the four sides erect. At least one of the framing members is formed from a strip of resilient material having two bends that separate a base from two arms. The base is attached to the bottom of the shell, and the arms are attached to two of the sides of the shell. One of the arms is foldable together with a first of the two sides against the base, and the other of the arms is foldable together with a second of the two sides against the first side for collapsing the shell into a substantially flat shape. However, the two arms remain resiliently opposed to being folded together for re-erecting said four sides of the shell.

The framing members, which are preferably made from flat spring steel, can be threaded into parallel channels that start along the first side, extend along the bottom, and end along the second side of the shell. The shell can be folded into a compact form with all three of the framing members in place within the parallel channels. A shoulder strap can be used as a cinch for securing the shell in the compact form.

Another version of my invention, which is particularly suitable for use as a soft-sided trunk, includes a flexible covering having a front, a back, and two end panels that extend from a bottom panel and a top panel that extends from the back panel. Framing members, which can be made from strips of resilient material, support the front, back, and two end panels perpendicular to the bottom panel. One of the framing members is bendable against a resilient torque about a first axis for folding the front panel toward the bottom panel and is bendable against a resilient torque about a second axis for also folding the back panel toward the bottom panel. The bottom panel is foldable together about a third axis that extends perpendicular to the first and second axes.

The two end panels can also be folded toward the bottom panel about fourth and fifth axes that extend parallel to said third axis. The top panel can be connected to the front panel and the two end panels with a zipper. The trunk, when fully erect, has a preferred height that is no more than its width and is less than one-half of its length to permit the trunk to be folded about its various axes into a flattened condition.

DRAWINGS

Figure 1:
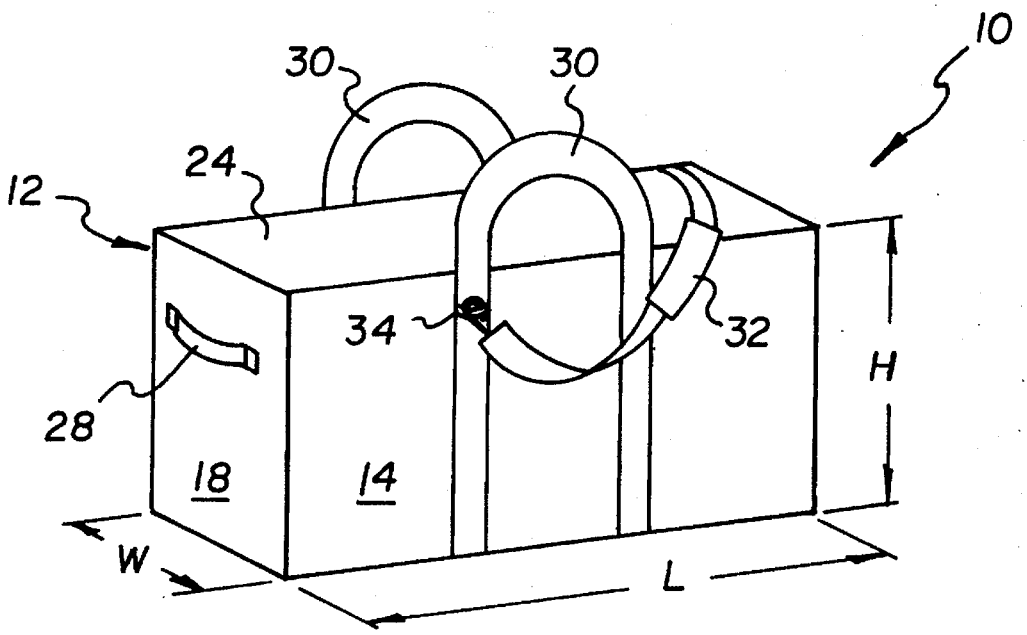
FIG. 1 is a perspective view of my invention as a framed duffel bag.
Figure 2:
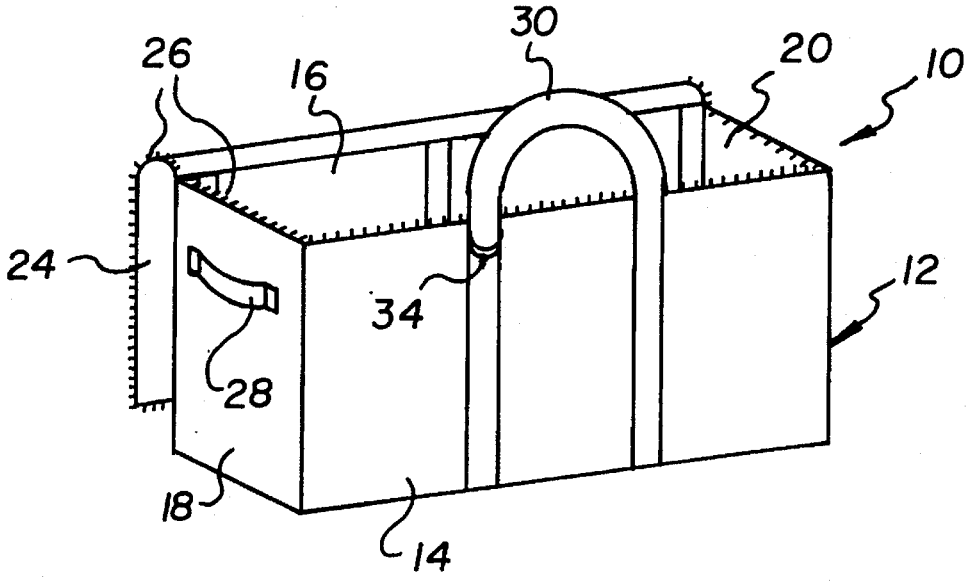
FIG. 2 is a similar perspective view of the duffel bag opened for loading.
Figure 3:
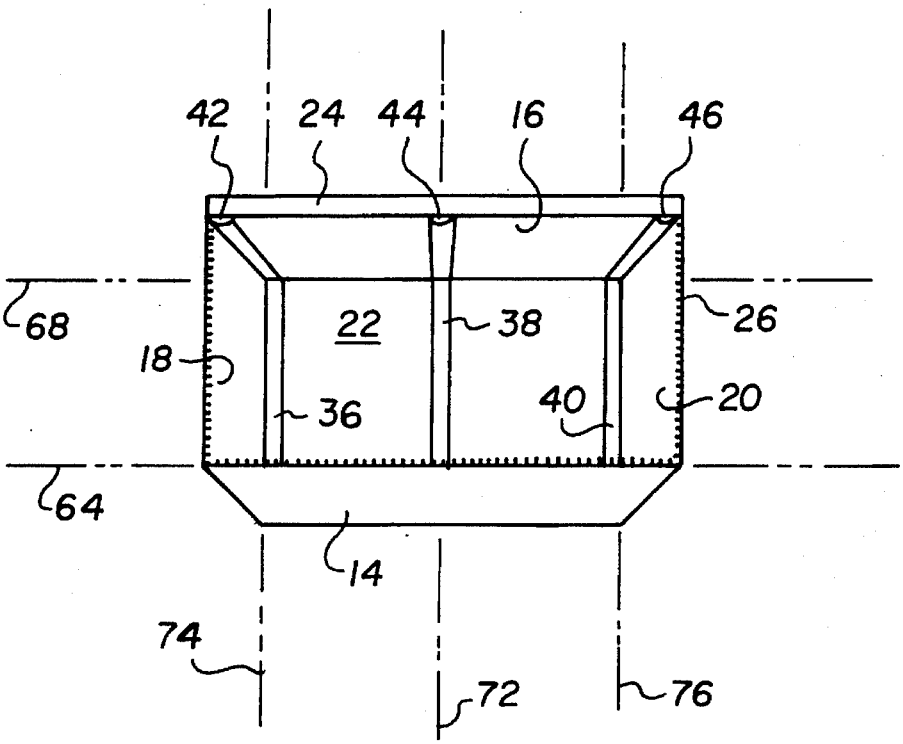
FIG. 3 is a top perspective view of the duffel bag omitting some exterior features, but showing more of the interior of the bag.
Figure 4:
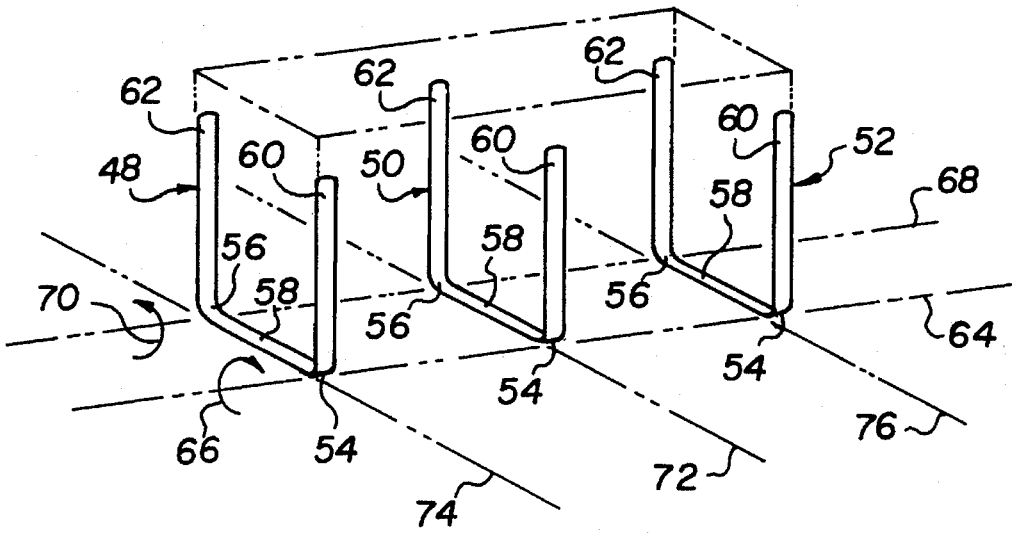
FIG. 4 is a phantom perspective view of the duffel bag with its shell removed for exposing three framing members.
Figure 5:
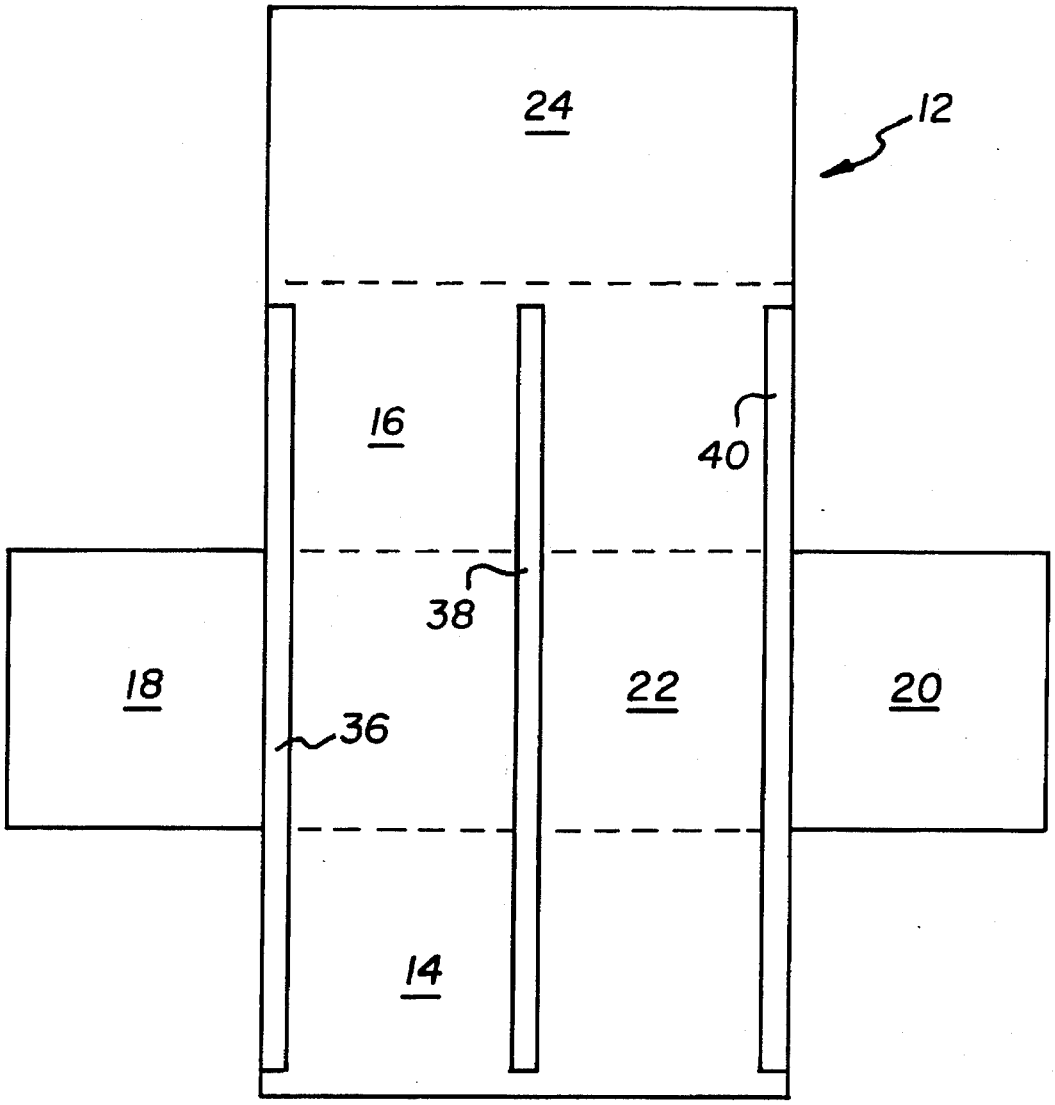
FIG. 5 is view of the shell as a pattern of fabric with pockets for attaching the framing members.
Figure 7A:
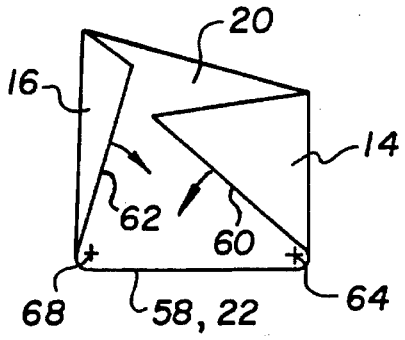
FIG. 7A is a schematic cross-sectional view similar to FIG. 6A, but showing alternative first steps for folding the bag.
Figure 7B:
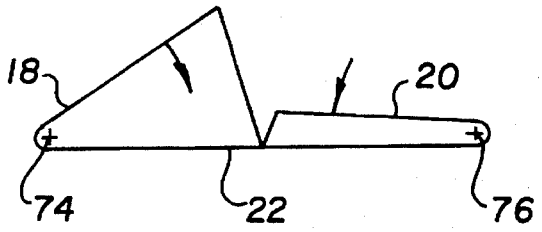

FIG. 7B is a schematic cross-sectional front view between longitudinal axes 64 and 68 of FIGS. 3 and 4 showing second steps for folding the bag.

Figure 7C:
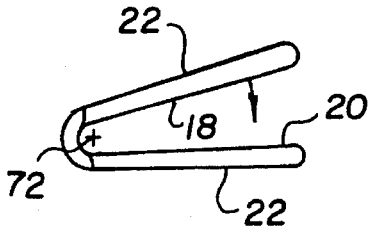

FIG. 7C is a schematic side view showing a third step for further compacting the bag.

DETAILED DESCRIPTION

A preferred embodiment of my invention is illustrated in FIGS. 1–5 as a framed duffel bag 10 that can be used as a soft-sided trunk. The duffel bag 10 has a fabric shell 12 made from a durable waterproof material such as 600 denier nylon or polyester with a PVC backing. The fabric shell 12 has four upright sides which include a front panel 14, a back panel 16, and two end panels 18 and 20. All four side panels 14, 16, 18, and 20 extend from a bottom panel 22, and a top panel 24 extends from the back panel 16.

The front and back panels 14 and 16 are sewn or otherwise connected to the two end panels 18 and 20. A zipper 26 connects the top panel 24 to the four side panels 14, 16, 18, and 20. Side handles 28 are attached to the two end panels 18 and 20, and top handles 30 are attached to the front and back panels 14 and 16. A removable shoulder strap 32 is also attached to the front and back panels 14 from supporting hoops 34 that are supported by the top handles 30. Either pair of handles 28 or 30, or the shoulder strap 32, can be used for carrying the duffel bag 10.

Three pockets 36, 38, and 40 are sewn or otherwise attached to an interior of the fabric shell 12. The three pockets 36, 38, and 40 form with the interior of the fabric shell 12 parallel channels 42, 44, and 46 that have a continuous length that starts along the front panel 14, continues along the bottom panel 22, and ends along the back panel 16. Three framing members 48, 50, and 52 made from strips of resilient material are threaded through the three pockets 36, 38, and 40 along the length of the channels 42, 44, and 46. Preferably, the framing members 48, 50, and 52 are made from flat spring steel about 0.75 inches wide and 0.042 inches thick. Ends of the framing members 48, 50, and 52 are rounded (or coated) to facilitate threading along the channels 42, 44, and 46 without tearing the shell 12.

Each of the three framing members 48, 50, and 52 has two permanent bends 54 and 56, which are preferably made on a small ninety degree radius of about 0.50 inches. The bends 54 and 56 separate a base 58 from two arms 60 and 62 that extend perpendicular to the base 58. Within the respective channels 42, 44, and 46, the base 58 of each framing member is attached to the bottom panel 22, and the two arms 60 and 62 are respectively attached to the front and back panels 14 and 16. The three framing members 48, 50, and 52 hold the four side panels 14, 16, 18, and 20 erect perpendicular to the bottom panel 22.

The erect duffel bag 10 holds an open form for loading similar to a hard-walled or rigidly reinforced trunk. However, after loading, the flexible shell 12 and the resilient framing members 48, 50, and 52 permit some temporary deformation of the bag 10 to provide more possibilities for stowing the bag 10 within fixed confines. After unloading, the bag 10 can be compacted for storage as shown in the remaining drawing figures.

Figure 6A:
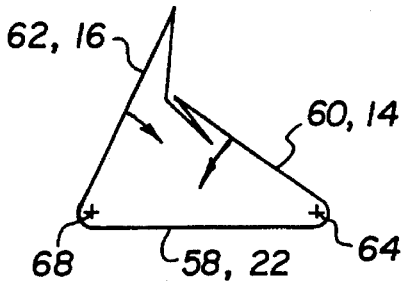
FIG. 6A is a schematic cross-sectional end view cut along a transverse axis 72 of FIGS. 3 and 4 showing first steps for folding the bag.
Figure 6B:
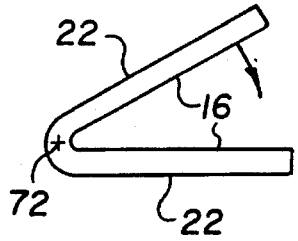
FIG. 6B is a schematic front view showing another step for further compacting the bag.

In FIGS. 6A–B, the arms 60 of the framing members 48, 50, and 52 are bent about a first longitudinal axis 64 against a resilient torque 66 for folding the front panel 14 against the bottom panel 22, and the arms 62 of the same framing members are bent about a second longitudinal axis 68 against a resilient torque 70 for folding the back panel 16 against the folded front panel 14. The front and back panels 14 and 16 could also be folded in the reverse order. Thereafter, the bottom panel 22 is folded together with the folded front and back panels 14 and 16 around a transverse axis 72 for further compacting the duffel bag 10. The height "H" of the front and back panels 14 and 16 is preferably not more then the width "W" of the end and bottom panels 18, 20, and 22 to prevent interference between the folded panels. The bag 10 can be folded with the zipper 26 substantially closed, leaving only enough space between the top panel 24 and one of the side panels 14, 16, 18 and 20 to allow air to escape. Alternatively, the top panel 24 could be unzipped and folded against the back panel 16 before folding the front and back panels 14 and 16 toward the bottom panel 22.

In FIGS. 7A–C, only the arms 60 and 62 of the framing member 50 are bent with associated portions of the front and back panels 14 and 16 toward the bottom panel 22. In place of bending the framing members 48 and 52 about the longitudinal axes 64 and 68, the end panels 18 and 20 are bent around transverse axes 74 and 76 toward the bottom panel 22. Preferably, the height "H" of the end panels 18 and 20 is less than one-half of the length "L" of the bottom panel 22 to permit both end panels 18 and 20 to be flattened against the bottom panel 22 without touching each other. Once flattened, the bag 10 is further compacted by folding the bottom panel 22 together around the transverse axis 72. After compacting, the shoulder strap 32 can be wrapped around the bag 10 and fastened together to form a cinch for holding the bag 10 in the compacted form.

The above description recites preferred features of my invention, but many other modifications and substitutions will be apparent to those of skill in the art. For example, the four side panels 14, 16, 18, and 20 that extend from the bottom panel could be formed from separate panels of fabric that are joined together into the prescribed pattern. More or less framing members could be used and other reinforcers could be added in keeping with the prescribed functions of the bag 10. Mesh sides could be added as windows and air holes for pets, zippers could be used to attach one or more of the side panels 14, 16, 18, and 20, wheels could be attached to the bottom panel 22 for rolling the bag 10, and an elastic band or mating fasteners attached to the bag 10 could be used in place of the shoulder strap 32 to secure the bag 10 in a compact form.

I claim:

1. A soft-sided article of luggage comprising:

a fabric shell having a box shape with four sides joined by a bottom and a top;

framing members for holding said four sides erect;

at least one of said framing members being formed from a strip of resilient material;

said strip of resilient material having two bends that separate a base from two arms;

said base being attached to said bottom of the shell and said arms being attached to two of said sides of the shell;

a first of said two sides being foldable together with one of said arms against said bottom of the shell, and a second of said two sides being foldable together with the other of said arms against said first side for collapsing said shell into a substantially flat shape;

said two arms being resiliently opposed to being folded together for re-erecting said four sides of the shell;

a cinch for holding said two arms folded together; and said cinch being a strap for carrying the article.

2. The article of claim 1 further comprising a channel formed along said bottom and said two sides for attaching said strip of resilient material to said shell.

3. The article of claim 2 in which said channel has a length that starts along said first side, continues along said bottom, and ends along said second side of the shell.

4. The article of claim 3 in which said strip of resilient material is threadable throughout said length of the channel.

5. The article of claim 2 in which said framing members extend parallel to each other.

6. The article of claim 5 in which said framing members are made from a flat spring steel.

7. The article of claim 1 in which said article when erect has a length, a width, and a height.

8. The article of claim 7 in which said height is no greater than said width to provide clearance for folding said two sides together.

9. The article of claim 8 in which said height is not more than one-half of said length to provide clearance for folding both said two ends and said bottom together.

10. A lightweight, easy-loading article of luggage that can be compacted for occupying less space comprising:

a flexible covering having a front, a back, and two end panels that extend from a bottom panel and a top panel that extends from said back panel;

framing members supporting said front, back, and two end panels perpendicular to said bottom panel;

at least one of said framing members being made from a strip of resilient material;

said one framing member being bendable against a resilient torque about a first axis for folding said front panel toward said bottom panel and being bendable against a resilient torque about a second axis for folding said back panel toward said bottom panel;

said bottom panel being foldable together about a third axis that extends perpendicular to said first and second axes;

three of said framing members being made from strips of resilient material;

all three of said framing members being bendable against respective resilient torques about said first axis for folding said front panel toward said bottom panel and being also bendable against respective resilient torques about said second axis for folding said back panel toward said bottom panel; and each of said strips of resilient material having two bends that separate a base from two arms.

11. The article of claim 10 in which said two end panels are also foldable toward said bottom panel about fourth and fifth axes that extend parallel to said third axis.

12. The article of claim 11 in which said article has a length, a width, and a height; and said height is not more than one-half of said length.

13. The article of claim 11 in which said top panel is connected to said front panel and said two end panels with a zipper.

14. The article of claim 10 in which said base of each strip is attached to said bottom panel, a first of said two arms of each strip is attached to said front panel and a second of said two arms of each strip is attached to said back panel.

15. The article of claim 14 in which said first arms of all three strips are foldable together with said front panel against said bottom panel, and said second arms of all three strips are foldable together with said back panel against said folded front panel for collapsing said article into a substantially flat shape.

16. A lightweight, easy-loading article of luggage that can be compacted for occupying less space comprising:

a flexible covering having a front, a back, and two end panels that extend from a bottom panel and a top panel that extends from said back panel;

framing members supporting said front, back, and two end panels perpendicular to said bottom panel;

at least one of said framing members being made from a strip of resilient material;

said one framing member being bendable against a resilient torque about a first axis for folding said front panel toward said bottom panel and being bendable against a resilient torque about a second axis for folding said back panel toward said bottom panel;

said bottom panel being foldable together about a third axis that extends perpendicular to said first and second axes; and a channel formed in said front, bottom, and back panels for attaching said strip of resilient material to said covering.

17. The article of claim 16 in which three of said framing members are made from strips of resilient material.

18. The article of claim 17 in which all three of said framing members are bendable against respective resilient torques about said first axis for folding said front panel toward said bottom panel and are also bendable against respective resilient torques about said second axis for folding said back panel toward said bottom panel.

19. The article of claim 16 in which said channel has a length that starts along said front panel, continues along said bottom panel, and ends along said back panel.

20. The article of claim 19 in which said strip of resilient material is threadable throughout said length of the channel.

* * * * *